United States Patent [19]

Hoshi

[11] 4,129,057

[45] Dec. 12, 1978

[54] KEYBOARD SUPPORT MECHANISM FOR ELECTRONIC ORGANS

[75] Inventor: Yoshitomo Hoshi, Showa, Japan

[73] Assignee: Kabushikigaisha Kawaigakkiseisakusho, Shizuokaken, Japan

[21] Appl. No.: 835,135

[22] Filed: Sep. 21, 1977

[30] Foreign Application Priority Data

Sep. 29, 1976 [JP] Japan ..... 51-129853[U]

[51] Int. Cl.[2] ..... G10C 3/12

[52] U.S. Cl. ..... 84/434

[58] Field of Search ..... 84/434, 435, 436, 423, 84/426, 353, 357, 358, 366, 225–232, 18, 20, 444, 227

[56] References Cited

U.S. PATENT DOCUMENTS

| | | | |
|---|---|---|---|
| 392,737 | 11/1888 | Lestina | 84/227 |
| 2,466,511 | 4/1949 | Swanson | 84/434 |
| 2,764,907 | 10/1956 | Link | 84/434 |
| 3,165,022 | 1/1965 | Yokoyama | 84/423 |

*Primary Examiner*—L. T. Hix
*Assistant Examiner*—S. D. Schreyer
*Attorney, Agent, or Firm*—Oblon, Fisher, Spivak, McClelland & Maier

[57] ABSTRACT

A support mechanism for keyboards of an electronic organ is provided, having a plate spring which mates at one end with a stopper projection formed on the lower end of a back side plate of a fixed plate attached to a keyboard chassis, the other end of the plate spring being inserted into the back end of the keyboard through a notch hole formed in a front side plate, such being at a different level than the back plate projection, and with a fulcrum part of the back end of the keyboard being made to link with a fulcrum projection formed in the front side plate.

5 Claims, 11 Drawing Figures

KEYBOARD SUPPORT MECHANISM FOR ELECTRONIC ORGANS

BACKGROUND OF THE INVENTION

1. Field of the Invention

This invention relates to a supporting mechanism of a keyboard of an electronic organ designed to make easy the maintenance and inspection thereof and also to reduce the number of its structural parts.

2. Brief Description of the Prior Art

Previously known foot pedal structures to which the present invention is directed, for use as supporting mechanisms for keyboards of electronic organs, are generally constructed as shown in FIG. 1, where a front pedal K is riveted with an end of a plate spring h at an end of a metal lever Ka, and the other end of the plate spring is attached to the under side of a fixed frame B, for example by a screw or screws, so that all of the parts are fixed to a keyboard chassis A. In such structure, many keyboards are required, each to be riveted with a plate spring which further must be screwed to the frame, resulting in the expenditure of many man-hours in the installation of the keyboard, and requiring many rivets or screws, to thereby result in economical disadvantage. Further, maintenance work on such structures requires removal of the keyboards or replacement of the plate springs, which makes a kind of troublesome work thereof.

SUMMARY OF THE INVENTION

Accordingly, it is an object of the present invention to solve the foregoing troubles of the known prior art, providing a suspension structure for the keyboard without adhering the supporting plate spring to the keyboard or the fixed frame, making installation or removal of the keyboard an easy task, and also reducing the number of parts, thereby producing a reduction in the cost and maintenance thereof.

BRIEF DESCRIPTION OF THE DRAWINGS

Various other objects, features and attendant advantages of the present invention will be more fully appreciated as the same becomes better understood from the following detailed description thereof, in which like reference numerals designate like or corresponding parts throughout, and wherein.

DETAILED DESCRIPTION OF A PREFERRED EMBODIMENT

Figure 1:
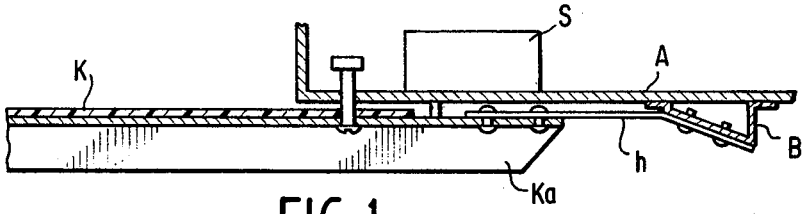
FIG. 1 is a partially sectional side view of a known keyboard suspension.
Figure 2A:
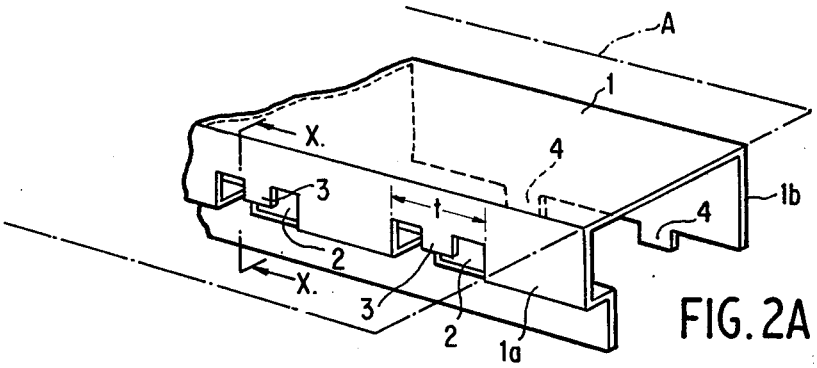
FIG. 2A is a perspective view of a fixed frame as an embodiment of the present invention.
Figure 2B:
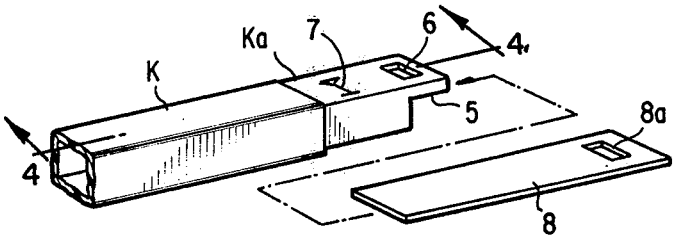
FIG. 2B is a perspective view of the rear end of the keyboard and a plate spring.
Figure 2C:
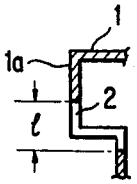
FIG. 2C is a sectional view, seen from the direction X—X of FIG. 2A.

Referring now to the drawings, and more particularly to FIGS. 2A, 2B and 2C, the main parts of a preferred embodiment of this invention are shown in an exploded, fragmentary fashion, a box-shaped fixed frame 1 being attached to the bottom side of a keyboard chassis A. An integral front side plate 1*a* of frame 1 is formed in a step-shaped configuration, being bent at its center in the backward direction, and having a plurality of notches 2 of predetermined width and spacing, striding the upper and lower vertical parts of the step-shaped plate. At the upper center part of each notch 2, in the upper leg of the step-shaped plate 1*a*, a projection or tab 3 hangs downwards, to serve as a fulcrum as will be described. A plurality of stopper projections 4 are provided, at the same predetermined spacing as the notches 2 of front plate 1*a*, at the bottom of an integral back plate 1*b* of frame 1, but projecting to a different, and lower, level than the notch 2, and being aligned with the projection 3.

On the other hand, a step 5 is formed by cutting off a certain portion of the sides of the back end (right side of the figure) of a metal lever Ka of the keyboard K, and a through hole 6, for providing a fulcrum, is made in the upper side of such back portion. The front portion of the metal lever Ka is provided with a downward projected crease 7, which is made to curve downward with cuts in both ends of the groove. A plate spring 8 of the required length is provided with a mating hole 8*a*, disposed in its rear portion, and the width d of the plate spring is made nearly equal to the inside width D of the metallic lever parts Ka of the keyboard.

Figure 3:
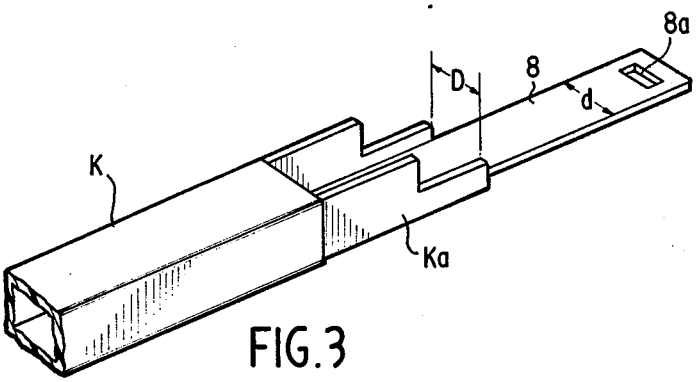
FIG. 3 is the under side view of the back end of a keyboard having inserted therein a plate spring.

Further, the notch 2 cut in the front side plate 1*a* of the fixed frame 1 has sufficient width t and height l so that the metal lever part Ka of the keyboard can be loosely fitted therein. To assemble the device, the plate spring 8 is first inserted from the rear of an upside down metallic lever part Ka of the keyboard, so that its front end will lie upon the downward projected crease 7 thereof (FIG. 3 shows this upside down state). This partial assembly is inserted into the corresponding notch 2 of the front side plate 1*a* of the fixed frame 1 from the front side, making matching hole 8*a* to fit with the projection 4 at the bottom of rear side plate 1*b*. At the same time, step 5 at the rear end of metallic part Ka of the keyboard will be made to fit in the notch hole 2 in the front side plate 1*a*, and make fulcrum projection 3 which was made to hang in the center of the notch hole 2, to meet with fulcrum hole 6 at the upper surface of the step 5.

Figure 4:
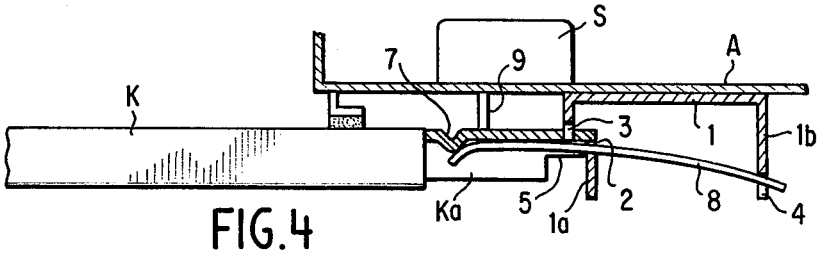
FIG. 4 is a partially sectional view of an example of the keyboard suspension structure of an embodiment of this invention.

FIG. 4 indicates the assembled status of a keyboard K into keyboard chassis A. Under this condition, plate spring 8 is supported at its rear half by the rear projection 4 and the lower edge of the front notch 2, and bends upwards, as shown in the drawing, because of the level difference between projection 4 and notch 2, and because the weight of keyboard K acts on the front half of the plate spring 8, yielding spring force reaction which holds the rear end of the keyboard K against fixed frame 1.

The projection 3 in the notch hole 2 acts as a fulcrum for the operation of the keyboard.

In FIG. 4, s indicates a switch box to start a musical sound and 9 indicates an actuating or operating plunger therefor.

In order to remove the keyboard K for inspection or for other purposes, the matching hole 8*a* of plate spring 8 is removed from the projection 4 of the rear side plate 1*b*, and also the through hole 6 at the upper surface of the metal part Ka of the keyboard is removed from the fulcrum projection 3, tilting the keyboard as necessary, whereby the keyboard K and plate spring 8 can easily be removed from the fixed frame 1 by pulling them forwards.

Figure 5A:
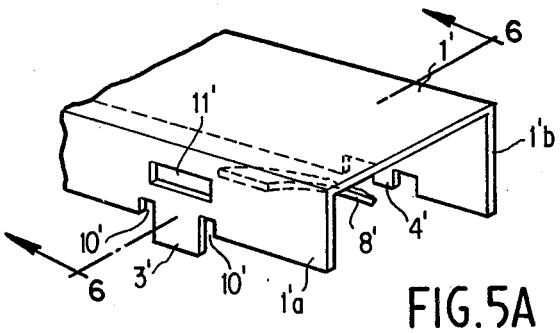
FIG. 5A is a perspective view of a modified embodiment of the fixed frame.
Figure 5B:
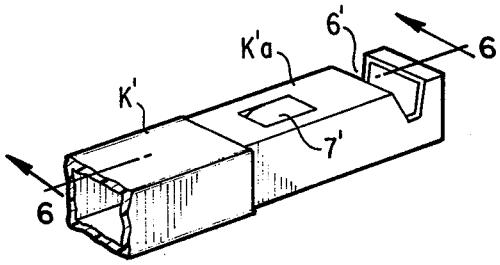
FIG. 5B is a perspective view of a modified embodiment of a keyboard rear end.
Figure 6:
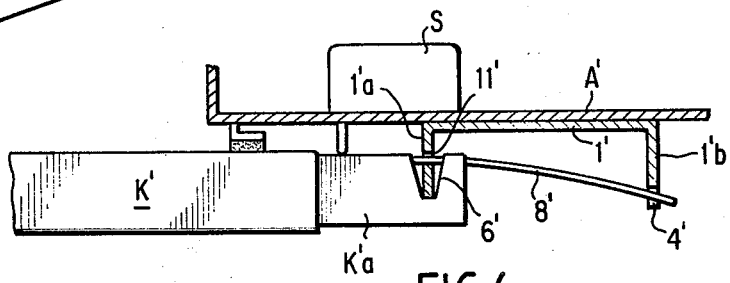
FIG. 6 is a partially sectional perspective view of another embodiment of the keyboard suspension mechanism.
Figure 7:
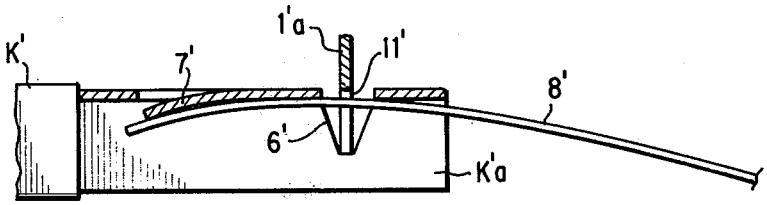
FIG. 7 is a sectional view indicating the joining condition of a tongue piece of metal parts and a plate spring.

FIG. 5 through FIG. 7 illustrate another embodiment of the present invention in which, at the bottom of the front side plate 1*a*′ of the fixed frame 1′, a plurality of fulcrum projections 3′ are formed, having accompanying slits 10′ at both sides thereof, and a through inserting hole 11′ is formed above each projection 3′ to be located at necessary intervals. A plurality of stopper projections 4′ are formed at the necessary intervals corresponding to the locations of the aforementioned projections 3′, being at a different level than the through inserting hole 11′, and the sides or openings or the sides of these stopper projections 4′ are cut so as to be able to meet with plate spring 8′, receiving the solid parts thereof on either side of the hole 8*a*′. Also, in the rear part of the metal part Ka′ of the keyboard K′, a deep notch for fulcrum 6′ is cut from the upper face to both sides thereof, and to the front part thereof a tongue piece 7′ is made to curve downward by cuts made to the front and both sides thereof. In assembly, first the notches 6′ at the rear end of the metal parts Ka′ of the keyboard K′ are made to meet with the fulcrum projections 3′ of the front side board 1*a*′ of the fixed frame 1′. Keeping this partially assembled condition, insert the front half of the plate spring 8′ in the inside of the metal part Ka′ through the through inserting hole 11′ at the rear end of metal parts Ka′ and on the frame, as shown by dotted line in the figure, and make the front end touch the under surface of the tongue piece 7′. Also make the mating hole 8*a*′ at the rear end fit the projection 4′ at the lower side of the rear side plate 1*b*′ and install keyboard K′ in the keyboard chassis as shown in FIG. 6.

In this embodiment, more stable support of the keyboard K′ is obtained because the fulcrum projection 3′ fits with a deeper notch 6′ of the metal Ka′ of the keyboard K′, and side deflection of the plate spring 8′ is prevented because its rear end and center part are fitted with notch and through hole 11′. Also, the curvature of plate spring 8′, as assembled, can be adequately adjusted by changing the extent of bending of tongue piece 7′ at the upper surface of the metal parts Ka′ shown in FIG. 7, which advantageously results in changing the feeling touch of the keyboard K′.

Disassembly of keyboard K′ is the reversal of the above. To start with, one dismantles the links of plate spring 8′ and takes it off, then detaches the joining of the fulcrum of keyboard K′, which allows it to be easily disassembled from a keyboard chassis.

Figure 8:
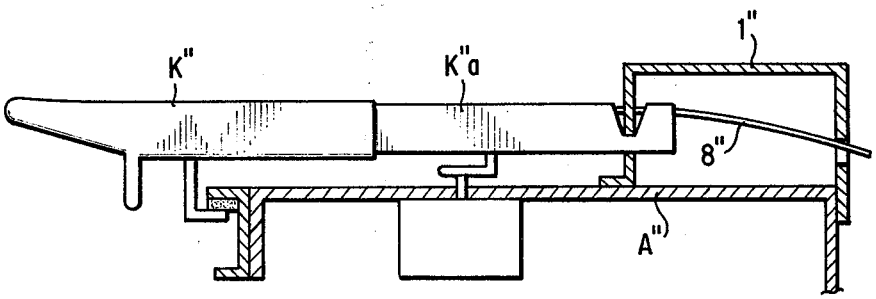
FIG. 8 is a partially sectional perspective view of an embodiment in a finger keyboard.

Further, FIG. 8 indicates yet another embodiment of the present invention, also directed to the finger keyboard K″, but in this case the difference lies in the means of attaching the fixed frame 1″ to the keyboard chassis A″, while the joining conditon of the metal parts Ka″ of the keyboard and the plate spring 8″ to the fixed frame 1″ are identical to that set forth in describing the embodiment in FIG. 5 through FIG. 7.

As was mentioned above, in this invention, the plate spring supporting the keyboard is not adhered to the keyboard or the fixed frame, but is made to attach as inserted, resulting in the quite simple assembly or fixing of keyboards and consequently to make an easier process of good efficiency. The number of parts may also be reduced, by not using rivets or screws, which was necessary in the prior art structure, and thus a reduction of production cost is achieved.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A supporting mechanism for the keyboards of an electronic organ, comprising;
   - a frame member adapted to be attached to the bottom side of a keyboard chassis, said frame member having a front side plate and a back side plate;
   - said front side plate of said frame member having at least one opening formed therein and a projecting tab;
   - said back side plate having at least one stopper projection being aligned from front to rear with a corresponding projecting tab of said front side plate;
   - a keyboard lever for each keyboard of said organ, said keyboard lever having an opening formed in one end, adapted to receive said projecting tab of said front side plate of said frame member, and a depending portion formed forwardly thereof; and
   - a spring plate member for each keyboard lever adapted to be retained therein with one end being supported against said depending portion thereof, and having an opening formed near the other end, said spring plate being adapted to be inserted through one of said openings formed in said front side plate of said frame member until said opening in the other end of said spring plate receives said stopper projection in said back side plate thereof.

2. A mechanism for supporting the keyboards of an electronic organ as set forth in claim 1, wherein said front side plate of said frame member is formed in a step-like configuration having two parallel vertical riser portions joined by a horizontal step portion, and wherein said at least one opening is at least one notch which vertically extends across a portion of both vertical riser portions.

3. A mechanism for supporting the keyboards of an electronic organ as set forth in claim 2, wherein said projecting tab formed in said front side plate of said frame member has a vertical extent less than that of the notched portion of the vertical riser portion from which said projecting tab is formed, and wherein said projecting tab of said front side plate is at a different level than that of the corresponding stopper projection in the back side plate.

4. A mechanism for supporting the keyboards of an electronic organ as set forth in claim 1, wherein said at least one opening in said front side plate of said frame member is disposed above said projecting tab thereof for receiving said spring plate and wherein slots are formed on both sides of said projecting tab in said front side plate.

5. A mechanism for supporting the keyboards of an electronic organ as set forth in claim 4, wherein said opening in said one end of said keyboard lever is a deep notch formed laterally thereacross, such that said projecting tab of said front side plate may be received therein while the sides of the keyboard lever about said deep notch may be received in said slots of said front side plate.

* * * * *